US010337827B1

(12) United States Patent
Holmes et al.

(10) Patent No.: US 10,337,827 B1
(45) Date of Patent: Jul. 2, 2019

(54) UPPER RECEIVER STRUT AND CLEANING ROD GUIDE

(71) Applicants: Fred J. Holmes, Wilbraham, MA (US); Mark E. Jenkinson, Wilbraham, MA (US)

(72) Inventors: Fred J. Holmes, Wilbraham, MA (US); Mark E. Jenkinson, Wilbraham, MA (US)

(73) Assignee: Present Arms, Inc., Wilbraham, MA (US)

( * ) Notice: Subject to any disclaimer, the term of this patent is extended or adjusted under 35 U.S.C. 154(b) by 0 days.

(21) Appl. No.: 15/904,219

(22) Filed: Feb. 23, 2018

(51) Int. Cl.
*F41C 27/00* (2006.01)
*F41A 31/02* (2006.01)
*F41A 29/02* (2006.01)

(52) U.S. Cl.
CPC ..... *F41C 27/00* (2013.01); *F41A 29/02* (2013.01); *F41A 31/02* (2013.01)

(58) Field of Classification Search
CPC ..... F41C 27/00
USPC ..... 42/108
See application file for complete search history.

(56) References Cited

U.S. PATENT DOCUMENTS 3,222,808 A * 12/1965 Smith ..... A47B 27/00 42/44
8,474,171 B1 * 7/2013 Simmons ..... F41A 11/04 42/108
2014/0115937 A1 * 5/2014 Harman ..... F41C 33/06 42/70.11

* cited by examiner

*Primary Examiner* — Stephen Johnson
(74) *Attorney, Agent, or Firm* — Michael Petrin; Antero, Tormey & Petrin, PC

(57) ABSTRACT

A strut tool including a hook portion for engaging an upper receiver assembly and a pivoting portion for engaging the takedown pin of a lower receiver assembly of a firearm that acts as a removable strut for holding the upper and lower receiver assemblies in a relatively aligned open angular position providing access to the inner bores and mechanisms of the firearm. The pivoting portion includes a bore accommodating the placement of the takedown pin in conjunction with the lower receiver assembly providing a pivotal connection permitting the angular alignment of the upper and lower receiver assemblies in an open and fixed position. The hook portion includes a takedown block engagement region that provides a means to accommodate the insertion and engagement of the takedown block present on the upper receiver assembly for the purpose of reversibly positioning and holding the strut tool in said relatively aligned position with respect to the lower receiver assembly. The hook portion optionally includes a upper channel with a longitudinal and semi-circular cutout region providing a guide slot for the relative positioning of cleaning and inspection tools with respect to the inner bore or breach of a rifle.

13 Claims, 8 Drawing Sheets

UPPER RECEIVER STRUT AND CLEANING ROD GUIDE

BACKGROUND

The present invention relates generally to tools for maintenance and repair of firearms, and more particularly to an improved tool for the inspection, cleaning and maintenance of a receiver assembly, breech, barrel and bore, including the upper and lower receiver components thereof, of a semiautomatic or automatic firearm or rifle.

Certain automatic and semiautomatic firearms such as the AR-15 rifle have removable and/or replaceable components, enabling repair, replacement and substitution with new or replacement parts, the receiver assembly being composed of additional subassemblies and parts that require inspection and cleaning to ensure proper maintenance and operation of the weapon, and thus needing to be disassembled and reassembled repeatedly. The disassembly and reassembly operations involve the removal of set pins, levers, springs and other components, many of which are small and easily lost, some of which are also susceptible to damage during this process owing to the force necessary to displace or insert friction fitting components associated with the receiver body of a weapon. For example, the AR-15 rifle has a receiver assembly composed of an upper receiver assembly and a lower receiver assembly connected by means of a pivot pin and a takedown pin that pass through interlocking pivot pin and takedown pin assembly blocks, respectively, located in the respective upper and lower receiver assemblies. In a typical disassembly procedure, the AR-15 rifle (and other similar weapons) is placed on one side on a flat surface and a pivot pin removal tool, such as a round pin punch is position against the pivot or takedown pin and struck with a hammer to displace and then further to dislodge the pin from the receiver assembly, which can be disassembled after both pins have been removed.

In servicing a rifle without full disassembly of the upper and lower receivers, one typically either displaces to its ball detent or fully removes only the takedown pin, so that the upper and lower receiver assemblies can be angular displaced by pivoting about the pivot pin which remains in place, allowing access to the corresponding inner surfaces of the breech, barrel and bore of the upper receiver assembly and the internal components of the lower receiver assembly. However, holding the upper and lower receiver assemblies in a fixed and stable position remains problematic as blocks and wedges typically employed can easily be displaced or jogged out of position enabling movement of the receivers, potentially damaging portions of the weapon or pinching a user's fingers or hand in the process.

Accordingly, for servicing a rifle, it would be highly desirable to have a tool that would enable easy access to the breech, barrel and bore of the rifle for inspection, cleaning and servicing, inspection and servicing of the upper and lower receiver assemblies thereof, and wherein the tool would hold the upper and lower receivers of the rifle in an open and angularly oriented position with respect to one another so as to provide such ease of access while stabilizing the receivers in a fixed, stable position.

SUMMARY

The present invention relates to a strut tool including a hook portion for engaging an upper receiver assembly and a pivoting portion for engaging the takedown pin of a lower receiver assembly of a firearm that acts as a removable strut for holding the upper and lower receiver assemblies in a relatively aligned open angular position providing access to the inner bores and mechanisms of the firearm. The present invention also relates to a strut tool where the pivoting portion includes a bore accommodating the placement of the takedown pin in conjunction with the lower receiver assembly providing a pivotal connection permitting the angular alignment of the upper and lower receiver assemblies in an open and fixed position. The present invention also relates to a strut tool where the hook portion includes a takedown block engagement region that provides a means to accommodate the insertion and engagement of the takedown block present on the upper receiver assembly for the purpose of reversibly positioning and holding the strut tool in said relatively aligned position with respect to the lower receiver assembly. In addition, the present invention relates to a strut tool where the hook portion optionally includes a upper channel with a longitudinal and semi-circular or V-shaped cutout region providing a guide slot for the relative positioning of cleaning and inspection tools with respect to the inner bore or breach of a rifle.

Yet further, the present invention relates to a strut tool for servicing a firearm including a hook portion for engaging the upper receiver assembly of a firearm and a pivoting portion for engaging the takedown pin of the lower receiver assembly of the firearm; wherein the pivoting portion includes a bore for receiving the takedown pin of the lower receiver assembly; and wherein the hook portion optionally includes a takedown block engagement region.

The present invention also relates to a strut tool wherein the hook portion and the pivoting portion acts to reversibly hold the position of the upper receiver and the lower receiver in a relative angular orientation with respect to one another by means of engaging the takedown block of the upper receiver while simultaneously engaging the takedown pin of the lower receiver assembly.

The present invention further relates to a strut tool wherein the hook portion includes a forward, flat edge region substantially parallel to the center axis of the hook portion; a forward, beveled region extending to the flat edge region and angled with respect to the flat edge region to accommodate insertion of the flat edge region into an interior breech or bore of the upper receiver assembly; a flat, top crown region extending from the beveled region; a rear, beveled region extending from the top crown region and angled with respect to the flat edge region; a rear, angled buffer block contact region extending from the rear beveled region and extending to a transition region; wherein the transition region further extends to a flat, rear region of the pivoting portion; and a takedown block engagement region, immediately adjacent to the front, flat edge region; extending inwardly from the flat edge region and including three internal surfaces: (i) an upper contact surface; (ii) a back contact surface; and (iii) a lower contact surface; wherein each of the upper contact surface, back contact surface and lower contact surface are oriented perpendicular with respect to each other; and wherein the back contact surface is oriented parallel to the center axis of the hook portion; and wherein the lower contact surface extends to a flat, forward region of the pivoting portion; wherein the lower contact surface is oriented perpendicular to the forward region of the pivoting portion.

The present invention also relates to a strut tool wherein the pivoting portion includes a flat, forward lower surface immediately adjacent to the takedown block engagement region; wherein the forward lower surface extends from the lower contact surface of the takedown block engagement region; wherein the forward lower surface is oriented substantially parallel to the center axis, and substantially perpendicular to the lower contact surface; a curved bore region extending from the forward lower surface and extending to a flat, rear surface extending to a transition region immediately adjacent to the rear, angled region; wherein the forward lower surface and the rear surface are oriented substantially in a parallel configuration; and the forward lower surface and the rear surface extend to a front portion and rear portion of the curved bore region, respectively; a bore hole located within and extending cross-sectionally through the curved bore region at the distal end of the pivoting portion with an outer wall corresponding to the external surface of the curved transition bore region; wherein the center of the bore hole defines one point along the center axis; and wherein the bore hole is internally sized to accommodate receiving the takedown pin of the lower receiver assembly to provide a pivoting means for the pivoting portion.

The present invention further relates to a strut tool wherein the cross-dimensional first thickness of the hook portion and the second thickness of the pivoting portion are the same; wherein the first thickness is equal in size to the length of an internal chord segment of an internal bore of a barrel opening of the upper receiver assembly when the hook portion is inserted into the internal bore making contact with the bore at two points of the internal chord segment corresponding to the opposed edges of the lower contact surface of the takedown block engagement region. Generally, the second thickness of the pivoting portion is selected to approximately equal with some tolerance for a tight frictional fit in size to that corresponding to the inner spacing of the lower receiver (internal distance between the two inner opposing wall surfaces near the takedown pin block region) into which the pivoting portion of the present inventive strut tool is placed in order to engage with the takedown pin.

The present invention relates yet further to a strut tool wherein the cross-dimensional thickness of the hook portion corresponds to the first thickness and the second thickness is dimensionally smaller than the first thickness. In this particular embodiment, this enables the inventive strut tool to have a first thickness in the hook portion to accommodate a larger bore size that the standard 0.223 Military ammo employed, larger caliber bullets requiring large bore sizes to fit in modified rifles, while the second thickness of the pivoting portion can be maintained at the size providing a frictional or snug fit within the lower receiver unit where it is placed to engage the takedown pivot pin.

In use, the embodiments of the present invention as disclosed herein are typically inserted hook portion first into the breech, barrel or bore of the angular displaced upper receiver unit, engaging the takedown block thereof, and then the combined upper receiver unit with hook portion in place is lowered until the through=bore of the pivoting portion of the strut tool comes into relative alignment with the bore of or the axis of the takedown pin, which is then fully inserted through the bore of the pivoting portion and into the opposite takedown pin bore hole on the lower receiver, a detent locking the takedown pin and place and thus securing the pivoting portion of the inventive strut tool in a fixed position, holding the upper and lower receiver units or assemblies in the desired, relatively angularly positioned desired or set by the over length of the struct tool and position of the through-hole bore of the pivoting portion with respect to the upper receiver.

In yet another embodiment, the present invention relates to a strut tool wherein the top crown region includes a depressed guidance region; wherein the guidance region is configured in the form of a semi-circular cross-sectional groove having a longitudinal aspect in a perpendicular orientation with respect to the center axis of the hook portion; and wherein the guidance region accommodates the positioning of a tool selected from a boring tool, cleaning rod, cleaning tool, inspection rod, inspection tool, fiber optic cable, or combinations thereof; or optionally wherein the guidance region is configured in the form of a V-shaped cross-sectional groove having a longitudinal aspect in a perpendicular orientation with respect to the center axis of the hook portion.

The present invention also relates to a strut tool wherein either one or both of the hook portion and the pivoting portion are partially cored to form one or a plurality of depressed regions extending inward from the face of the portion; wherein the depressed regions do not extend completely to the opposite face of the portion; or alternatively to a strut tool wherein the one or plurality of depressed regions extend inward from both opposed faces of either one or both of the hook portion and the pivoting portion to form opposed depressed regions on both of the opposed faces; wherein a layer of material remains between the opposed depressed regions.

The present invention further relates to a strut tool wherein one or more of the depressed regions are fully cored from one of the opposed faces to the opposite face creating an opening without an intervening layer of material.

In yet another series of embodiments, the present invention relates to a strut tool having a first and second opposed hook portions; wherein the first and second hook portions extend to the pivoting portion; wherein the openings of the respective first and second hook portions are oriented in opposite directions; or alternatively wherein the dimensions of the first and second hook portions are different in size in order to accommodate servicing of two separate rifles.

The present invention also relates to a strut tool wherein the pivoting portion includes a first and second bore for receiving the takedown pin of the lower receiver assembly; or alternatively to a strut tool wherein the pivoting portion includes a first and second bore for receiving the takedown pin of either a first or a second lower receiver assembly; and wherein the first bore and the second bore have a first internal diameter and a second internal diameter that correspond to the diameter of a first takedown pin and a second takedown pin, respectively, of a first and second rifle.

Figure 1:
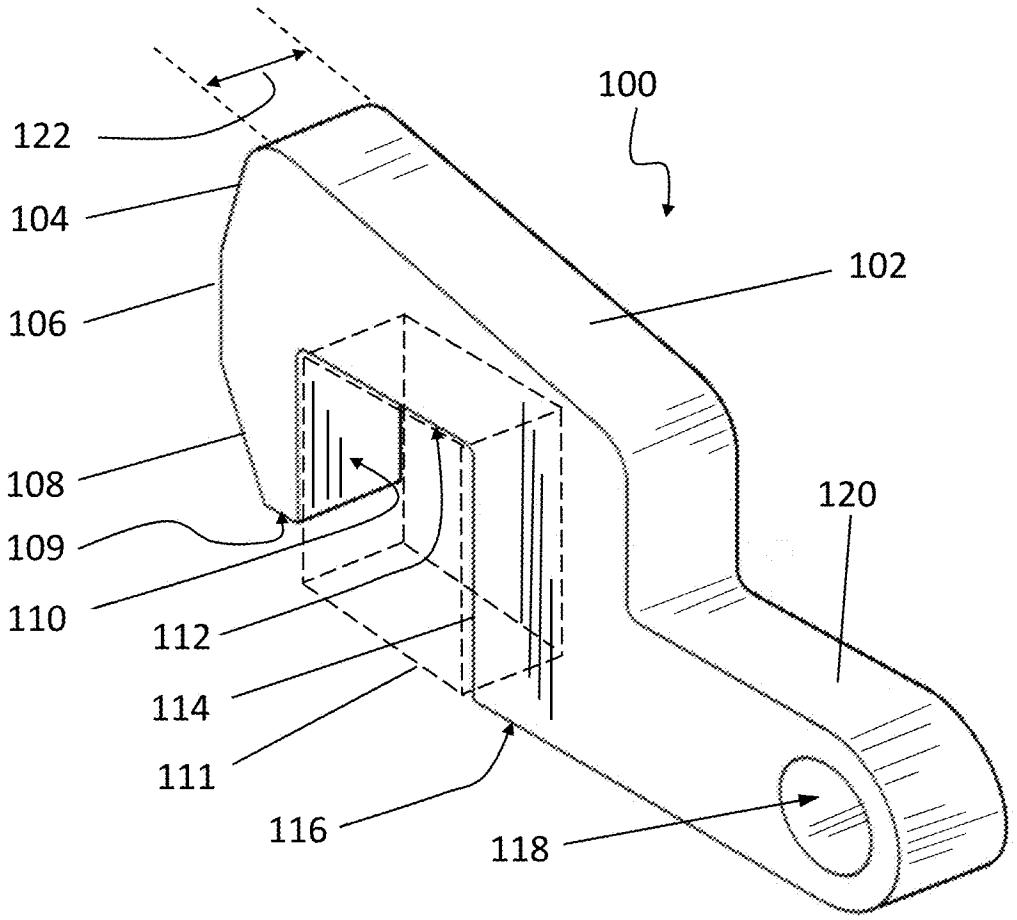
FIG. 1 shows one embodiment of a strut tool for holding the position of the upper and lower receiver assemblies in a relatively aligned open configuration with a securing and pivoting means.

A corresponding set of Figure Keys listing the specific component parts, regions and features of the present invention is found in the Appendix, attached hereinbelow.

DESCRIPTION

Generality of Invention

This application should be read in the most general possible form. This includes, without limitation, the following:

References to specific techniques include alternative and more general techniques, especially when discussing aspects of the invention, or how the invention might be made or used.

References to "preferred" techniques generally mean that the inventor contemplates using those techniques, and thinks they are best for the intended application. This does not exclude other techniques for the invention, and does not mean that those techniques are necessarily essential or would be preferred in all circumstances.

References to contemplated causes and effects for some implementations do not preclude other causes or effects that might occur in other implementations.

References to reasons for using particular techniques do not preclude other reasons or techniques, even if completely contrary, where circumstances would indicate that the stated reasons or techniques are not as applicable.

Furthermore, the invention is in no way limited to the specifics of any particular embodiments and examples disclosed herein. Many other variations are possible which remain within the content, scope and spirit of the invention, and these variations would become clear to those skilled in the art after perusal of this application.

Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Read this application with the following terms and phrases in their most general form. The general meaning of each of these terms or phrases is illustrative, not in any way limiting.

DETAILED DESCRIPTION

FIG. 1 shows one embodiment of a strut tool according to the present invention wherein the tool has a proximate hook portion for engaging the upper receiver assembly of a firearm and a distal pivoting portion for engaging the takedown pin of the lower receiver assembly of a firearm, such as a Colt AR-15 rifle. The hook portion includes a takedown block engagement region approximately in the shape of a rectangle with internal surfaces arranged in mutual perpendicular configuration with respect to one another, including a takedown block upper contact surface 110, a takedown block end surface 112 and a takedown block back contact or rest surface 114 that correspond to three sides of the takedown block engagement region 111 that is indicated in FIG. 1 as a rectangular space in dashed lines. The hook portion further includes a hook leading surface 109 that may be configured in the form of a forward, flat edge region that can fit within the bore or opening of the upper receiver assembly of a rifle. The hook portion further includes an entry bevel region 108 that may be configured in the form of a forward beveled region that extends from the hook leading surface 109 and continues to the top crown region 106 that extends to a second beveled region or rear hook bevel region 104 that extends to the buffer block contact surface 102 of the hook portion. The angle of the beveled regions 104 and 108 may take on any convenient angle between about 15 degrees to 60 degrees, or alternatively between 25 degrees and 45 degrees, or alternatively between 25 to 30 degrees, the forward or entry bevel region 108 acting to facilitate the entry of the hook portion of the inventive strut tool into a close fitting bore or opening.

Figure 2:
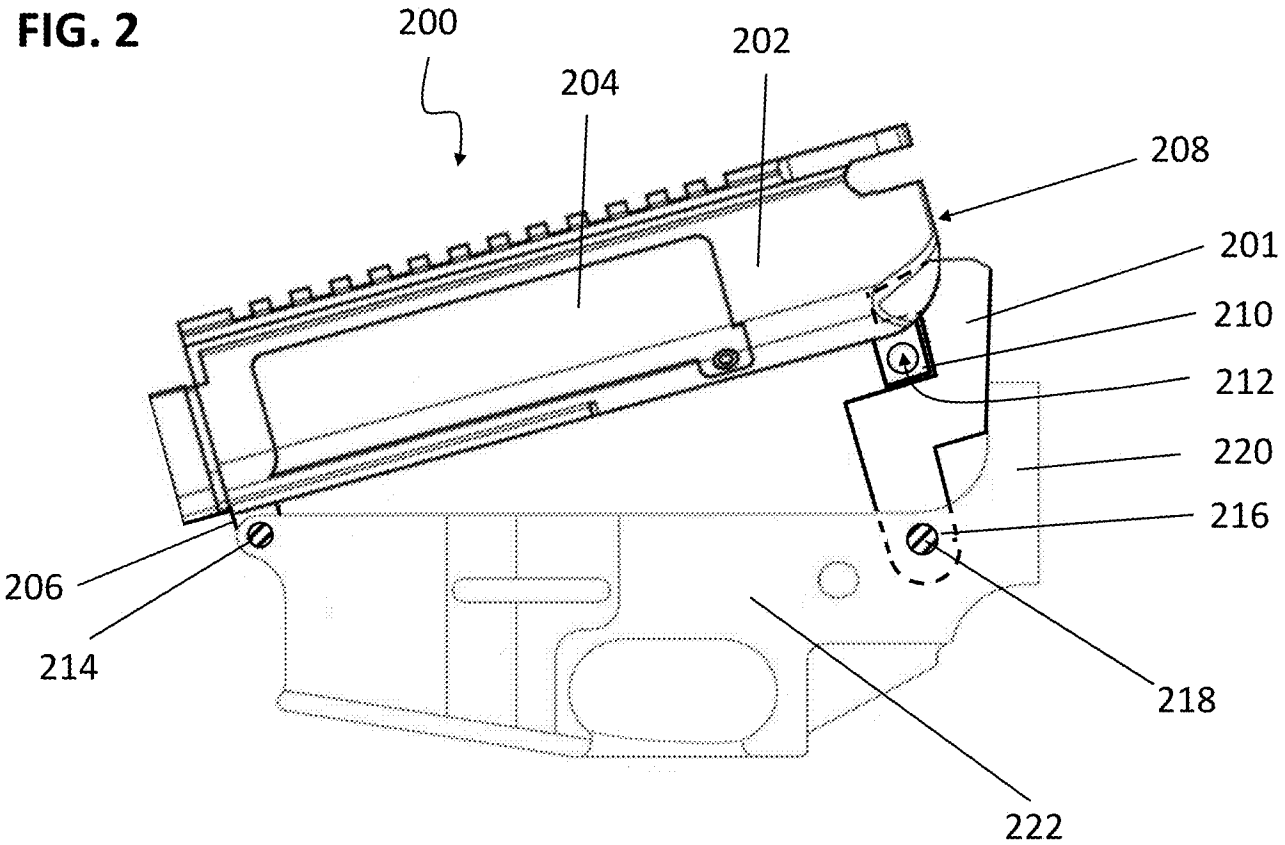
FIG. 2 shows one embodiment of a strut tool in position engaging the upper and lower receiver assemblies in an open position.
Figure 3:
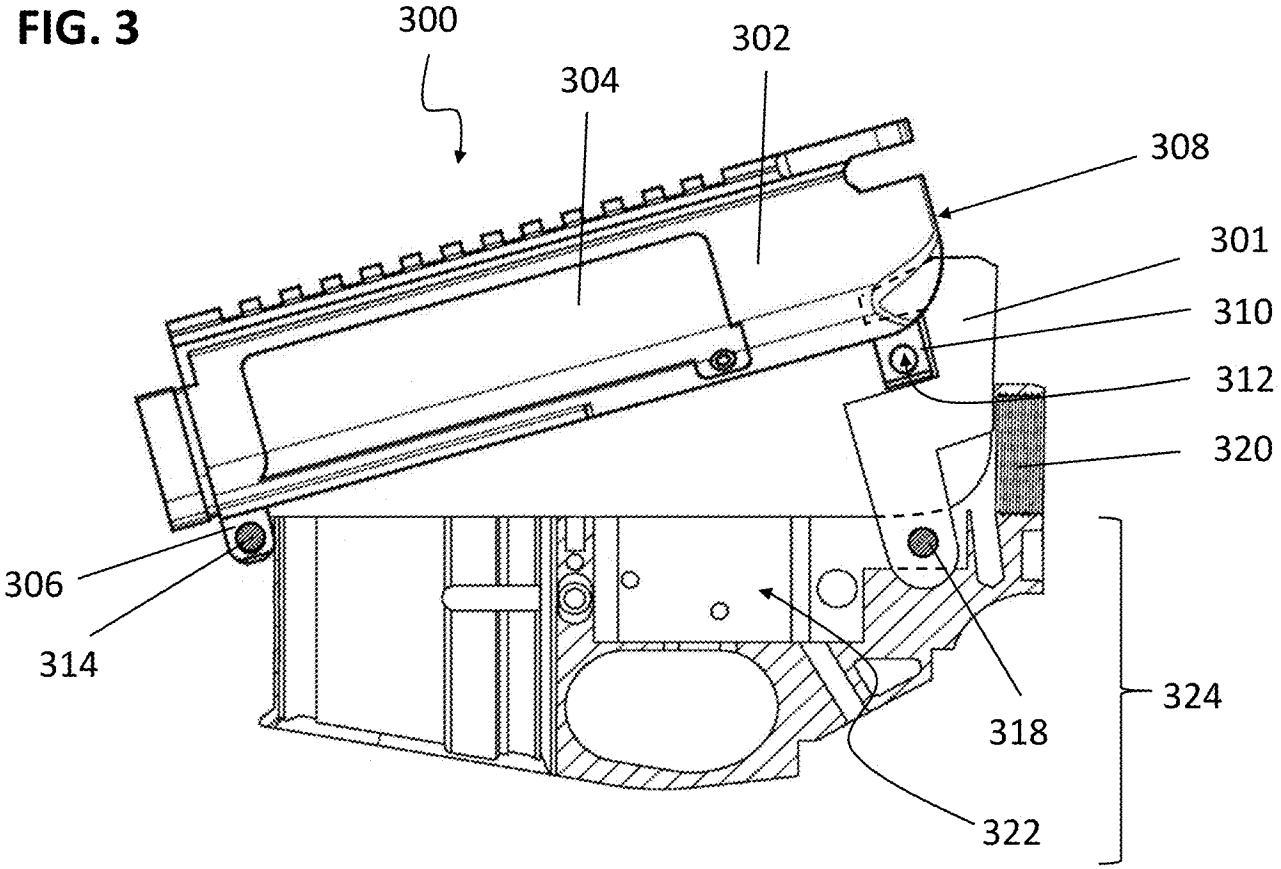
FIG. 3 shows one embodiment of a strut tool in position engaging the upper and lower receiver assemblies in an open position, with the lower receiver assembly shown in cutaway showing details of both the pivot block and pin and the takedown block and pin.

In operation, the takedown block engagement region 111 having walls 110, 112, and 114 accommodates the insertion of the takedown block located on a lower extremity and leading edge of the upper receiver. The embodiment of the inventive strut tool 100 shown in FIG. 1 also features a distal pivoting portion including a strut block takedown pin bore 118 sized for receiving the takedown pin of said lower receiver assembly, allowing the strut tool 100 to pivot about the takedown pin when the strut tool 100 is engaged with the lower receiver assembly, as illustrated in FIGS. 2 and 3. Here, the distal pivoting portion is defined by the strut body front surface 116 that extends from the takedown block lower contact surface 114 and which is approximately at right angles or perpendicular to the surface 114, and further extending to the distal end of the strut tool 100 where the strut block takedown pin bore 118 is located. The distal end of the strut tool 100 may be curved in one embodiment as shown, extending around the pin bore 118 into the distal rear surface 120 which is generally parallel to the front surface 116, and sized sufficiently to accommodate the diameter of the pin bore 118 with at least a minimum sufficient wall thickness surrounding said pin bore for structural integrity. the inner diameter of the strut block takedown pin bore 118 may be of any desired size, corresponding to the outer diameter of the takedown pin of the weapon being serviced, and optionally sized just sufficiently large in internal diameter to accommodate the pin with enough clearance to enable easy placement of the takedown pin and rotation about the pin when the strut tool 100 is in position. The distal rear surface 120 extends through a transition region to the buffer block contact surface 102, and may do so in any manner that enables the buffer block contact surface 102 in conjunction with the rear surface 120 to fully engage the buffer block portion of the lower assembly as the strut tool 100 is pivotably engaged therewith after insertion of 100 into the lower assembly of the weapon being serviced.

Figure 6:
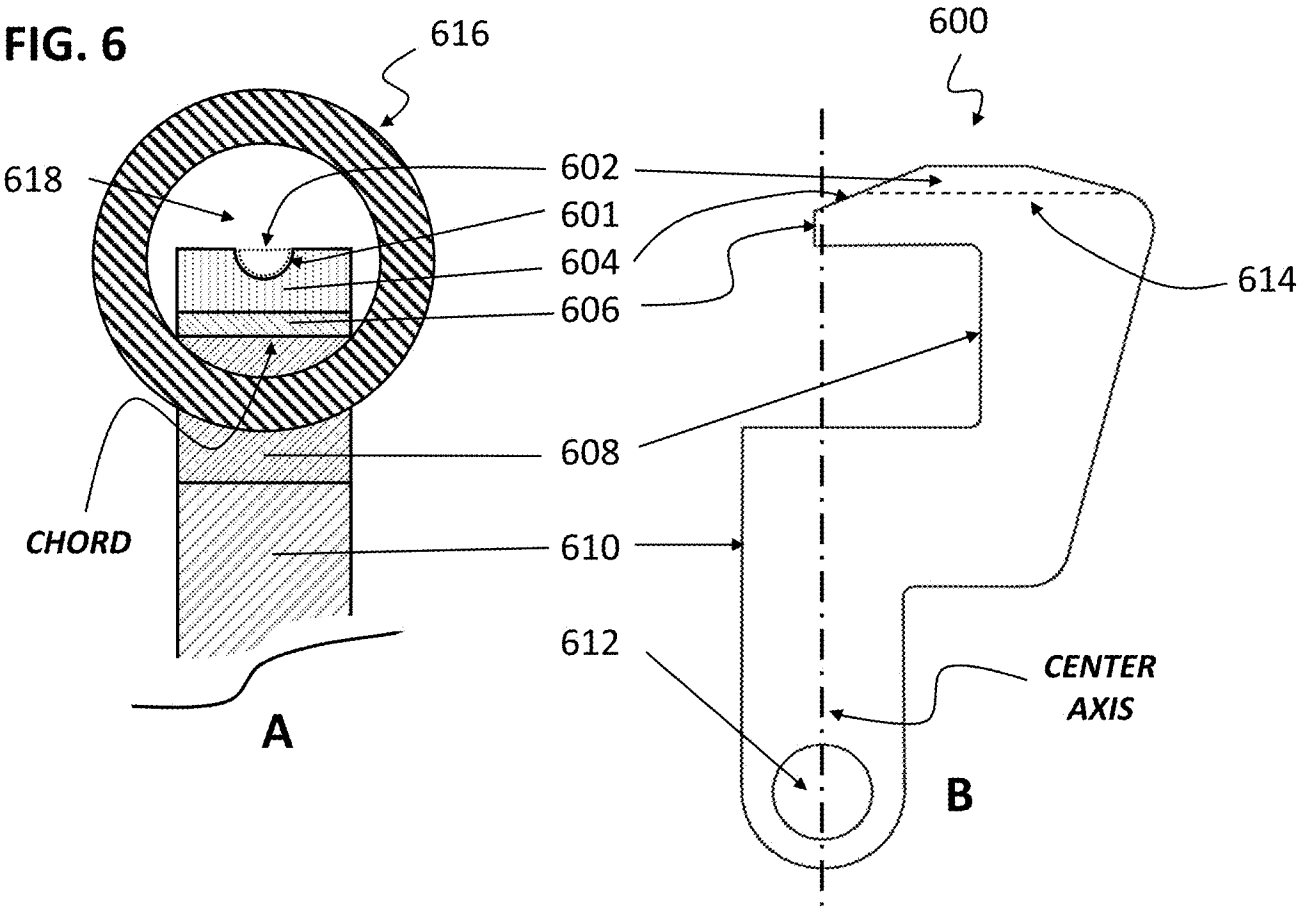
FIG. 6 shows one embodiment of a strut tool in position within the upper receiver assembly with respect to the inner bore and corresponding rifle bore axis with respect to the FIG. 7 shows four embodiments of a struct tool having various configuration options including hook length, a guidance slot, chambered construction and takedown block fitment cutouts.

The width or strut thickness dimension 122 may be of any selected size, but generally is selected with respect to the inner diameter of the rifle bore or opening into which the proximate end defined by the hook entry bevel region 108 is to be inserted, so that the forward flat and beveled regions 108 and 109 and the takedown block upper contact surface 110 fit snuggly within said rifle bore or opening in the lower receiver when the strut tool 100 is engaged, the lower edge of the hook leading surface 109 immediately adjacent to the takedown block upper contact surface 110 positioned along a chord internal to the rifle barrel diameter, as shown in FIG. 6 in greater detail and described more fully hereinbelow.

The engaging surfaces of the strut tool 100 are generally disposed in either a parallel or perpendicular configuration with respect to a center axis passing through the center of the strut block takedown pin bore 118 and parallel to the distal strut body front surface 116, including the hook leading surface 109 and the takedown block back contact surface 112. The takedown block is generally a rectangular structure machined into or present on lower edge of the upper receiver having a the takedown bore passing through it, so the takedown block engagement region 111 is defined by wall 110, 112 and 114 being perpendicularly oriented (square) with respect to one another, and the depth of the opening defined by 111 being sufficient to accommodate at least a portion of the takedown block of the upper receiver, while allowing the forward hook leading surface 109 sufficient clearance to enter the bore or opening of the upper receiver immediately adjacent to the takedown block. Accordingly, the surfaces 110 and 114 and top crown region 106 are generally disposed in a perpendicular orientation with respect to the center axis of the strut tool 100 as defined above.

In contrast, the rearward facing buffer block contact surface 102 is generally disposed at an angle with respect to the strut tool center axis, the angle generally being between 0 to 45 degrees, or alternatively between 0 to 30 degrees, or alternatively between 5 to 25 degrees, the angle selected so that the flat face of 102 is parallel to the interior face or interior flat surface portion of the threaded buffer coupling block (220 as shown in FIG. 2 below) when the strut tool 100 is in place.

FIG. 2 illustrates the engagement and positioning of one embodiment of the inventive strut tool 201, which shows the tool positioned in configuration 200 with an upper receiver 202 and lower receiver unit 222 shown connected through the pivot pin 214 passing through the respective units and the pivot block 206 that is formed or machined into the upper receiver 202 immediately adjacent to and below the port cover 204. Keeping the pivot pin 214 in place enables the free relative rotation and angular positioning of the upper and lower receivers. When the takedown pin 218 is removed, this frees the upper receiver 202 to pivot around the pivot pin 214, providing access to the inner workings and breech of the receiver units and enabling the inspection and cleaning of the upper receiver 202 and barrel of the rifle (not shown) that is threaded to the leftmost side (rear) of 202. When the takedown pin 218 is reinserted, the strut tool 201 is first positioned so as to align the strut block bore 216 with the lower receiver openings 219 (not shown) for the takedown pin 218, which is then slid through one side of the receiver 219, through the strut tool 201 passing through 216 and engaging the second side of the receiver 219, thus locking the strut tool 201 in position internally within the lower receiver unit 222 by means of the takedown pin 218, about which the strut tool 201 can partially rotate to place in the position shown, where the upper receiver takedown block 210 engages the takedown block engagement region 111 of 201, while simultaneously, the forward surface of the hook portion of 201 (as shown in dotted line) enters and engages the opening of the upper receiver port 208, and simultaneously, the buffer block contact surface 102 of 201 engages with the inner side of the threaded buffer coupling block 220 preventing any further forward (to the right) angular movement of 201, thus locking 201 in place, as shown. When the strut tool 201 is positioned as shown in FIG. 2, the upper and lower receiver units 202 and 222 are locked in a fixed and angular relationship determined by the length of the strut tool 201, the angular degree typically being between 5 degrees and 45 degrees, or alternatively between 10 and 30 degrees, for ease of access and convenience in servicing and inspecting the inner workings of the rifle, including the internal surfaces of the rifle barrel and breech.

FIG. 3 shows substantially the same positioning and orientation of one embodiment of a strut tool 301 in position engaging the upper and lower receiver units 300. Here, the lower receiver unit 322 is shown in a cross-sectional cutaway view 324, so that the lower end or distal pivoting portion of the strut tool 301 can be seen. Here, the strut tool 301 is positioned so that the hook portion is within the upper receiver port 308, the takedown block 310 is engaged with the takedown block engagement region of 301, and the buffer block contact surface of 301 is engaged with the inner surface of the threaded buffer coupling block 320, while the upper receiver unit 302 remains pivotably engaged with the lower receiver unit 322 by means of the takedown pin 314 present in the pivot block 306, holding 302 and 322 in the relative angular position as shown.

Figure 4:
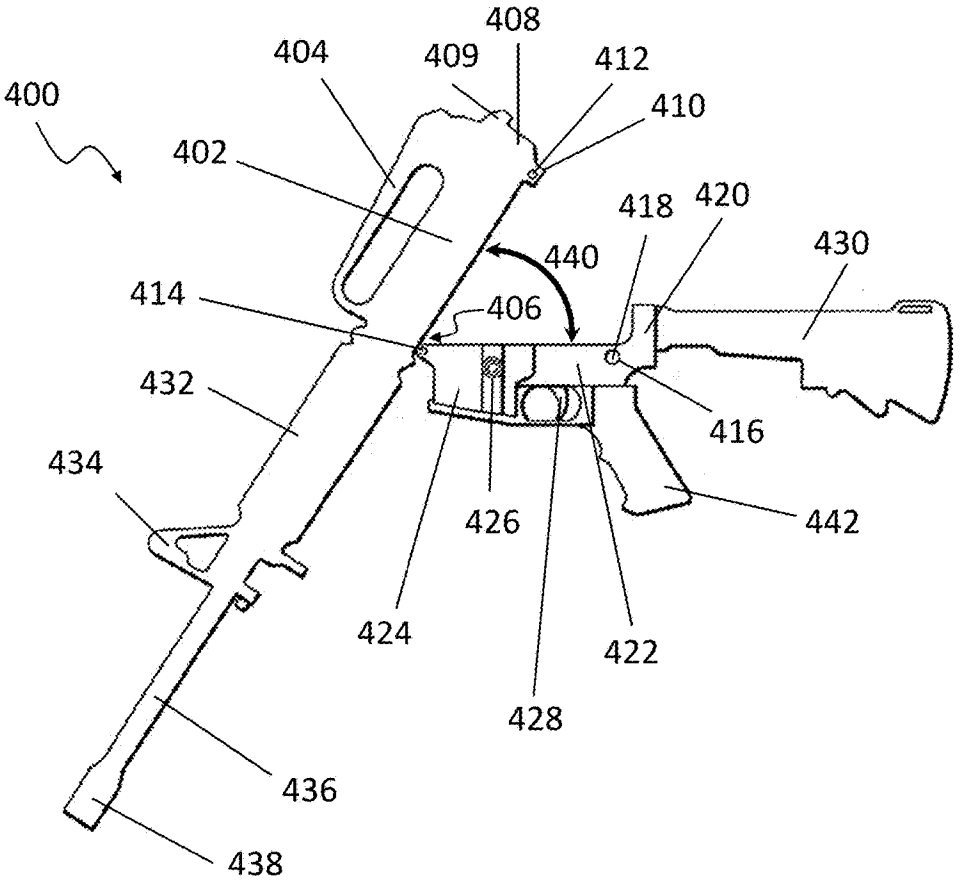
FIG. 4 shows a schematic of parts and assemblies of an AR15 rifle opened and pivoting about the pivot pin, and the position of the rifle barrel with respect to the upper receiver assembly.

FIG. 4 shows the a schematic of an AR-15 rifle 400, the various portions and parts labeled to aid in understanding the relative placement and positioning of the rifle components. Here, the upper receiver assembly 402 has a handle 404 with a rear sight (not shown) and extends to the barrel 436 with a barrel cover guard 432 which includes a front windage and front site assembly 434, the distal portion of barrel 436 terminating with a flash suppressor 438. On the other or proximate end of the upper receiver assembly 402, the upper receiver port 408 is open and exposed, showing the receiver engagement tang 409 of the breech, and the takedown block 410 with pin removed, showing the open takedown block bore 412. The upper and lower receiver assembly are shown pivoting about the pivot pin 414 that passes through them both and the pivot block 406 (not visible in this view), at an angle represented by 440, which indicates the swivel direction. The lower receiver unit 422 features a magazine receiver 424, a magazine release button 426 adjacent to the trigger 428 and handle 442. The lower receiver assembly 422 features a buffer coupling block 420 to which the buffer assembly (not shown) is threadingly coupled and contained within the rifle stock 430. In this view, the takedown pin 418 (not shown) has been removed, showing the open takedown pin bore 416.

While an AR-15 rifle is illustrated herein to show the position and functioning of the inventive strut tool, additional embodiments of the inventive strut tool can be adapted by adjusting the width, length and takedown pin bore diameter, to accommodate positioning within any similar rifles and upper and lower receiver assemblies thereof, including the AR-15, AR-15A2, AR-15A3 and AR-15A4, Colt XM16 (Armalite), and Colt SMG, all products of the Colt Manufacturing Company, West Hartford, Conn., and other modern sporting rifles (MSR) having similar configurations to the Colt AR-15, including, but not limited to ArmaLite M-15, Barrett REC7, Bravo Company Manufacturing BCM Carbines and Rifles, Bushmaster XM-15, Carbon 15, Daniel Defense DDM4, DPMS Panther Arms Tactical Rifle, Haenel CR 223, Heckler & Koch MR556, Lewis Machine & Tool Company CQB16, LWRC International IC series, Midwest Industries MI series, Mossberg Tactical Semi-Automatic Rifles, Olympic Arms K series, Patriot Ordnance Factory rifles and carbines, Quality Arms Tactical series, Remington GPC, Rock River Arms LAR-15, Ruger SR-556, Savage Arms MSR-15, SIG MCX, SIG Sauer SIG516, SIG Sauer SIGM400, Smith & Wesson M&P15, Stag Arms STAG-15, Wilson Combat Tactical Rifle, Windham Weaponry R series and Yankee Hill Machine 8000 series rifles, and other rifles corresponding to Colt Model No.s. 601, 602, 603, 604, 605, 605 A & B, 606 A& B, 607 A&B, 608-609, 610, 610B, 611 and 611P, 613 K & P, 614 and 614 S, 615-616, 619-621, 629, 630, 633-636, 640; M16A1 variants 645-656 and M16A2 variants 701-746; M4 Carbines such as the Colt Automatic Rifle Model #750, 777-779, 901, 905, 920-921 and 921 HB, 925-977; M16A3 variants 941-945, and Colt SMG 991 and 922, as well as other Colt AR15, M15, M16, M4 variants without a corresponding Colt Model number designation.

Figure 5:
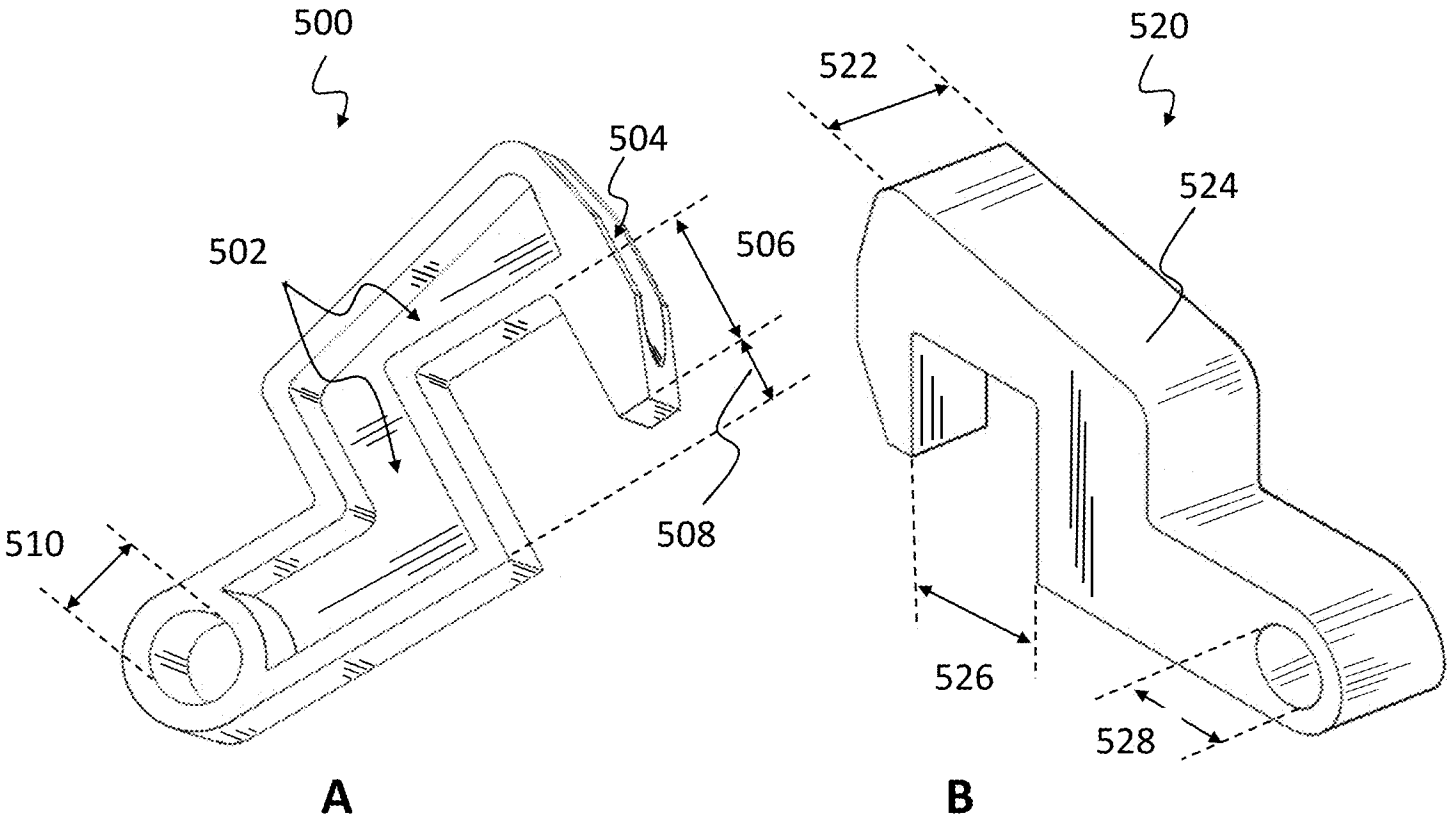
FIG. 5 shows two embodiments of a strut tool wherein a first embodiment features a chambered construction and a second embodiment features a solid construction means.

In FIG. 5, other embodiments of the inventive strut tool are illustrated, including a cored or chambered version 500 in which some of the non-contact tool surfaces have been machined away or demolded to leave an open space or cavity to decrease the amount of material needed for construction of a chambered or cored strut tool 500. In this embodiment, tool 500 has been cored on one side, leaving a back wall (not shown) intact for structural integrity with reduced overall mass or use of construction materials. Here, some of the bulk of the tool has been removed leaving recessed region 502. In other embodiments, the entire bulk of material corresponding to region 502 could be removed as well, providing that at least some material of construction remains surrounding the takedown pin bore 510 opening for structural stability. In embodiment 500, the inventive strut tool also features a guidance slot 504 that extends longitudinally along the top crown surface of the strut tool, enabling guidance for a cleaning rod, measuring tool or inspection tool. The hook depth 506 of the proximate hook portion of strut tool 500 is selected with regard to the configuration of the specific rifle or class of rifles to be serviced, the hook displacement spacing 508 being lengthened or shortened to accommodate the internal bore or opening of the intended upper receiver unit or upper receiver assembly.

In another embodiment, a solid strut tool 520 has a strut tool width 522 and a takedown hook width 526 with a takedown pin strut bore diameter 528 sized to accommodate an AR-10 rifle. Similar modifications in the width and spacing parameters, 506, 508, 526 and 528 as well as the overall length of the inventive strut tool, may be selected in order to enable the tool to accommodate the servicing of any selected AR-style rifle as disclosed herein. Such variations are disclosed in more detail in FIG. 7 hereinbelow.

Figure 7:
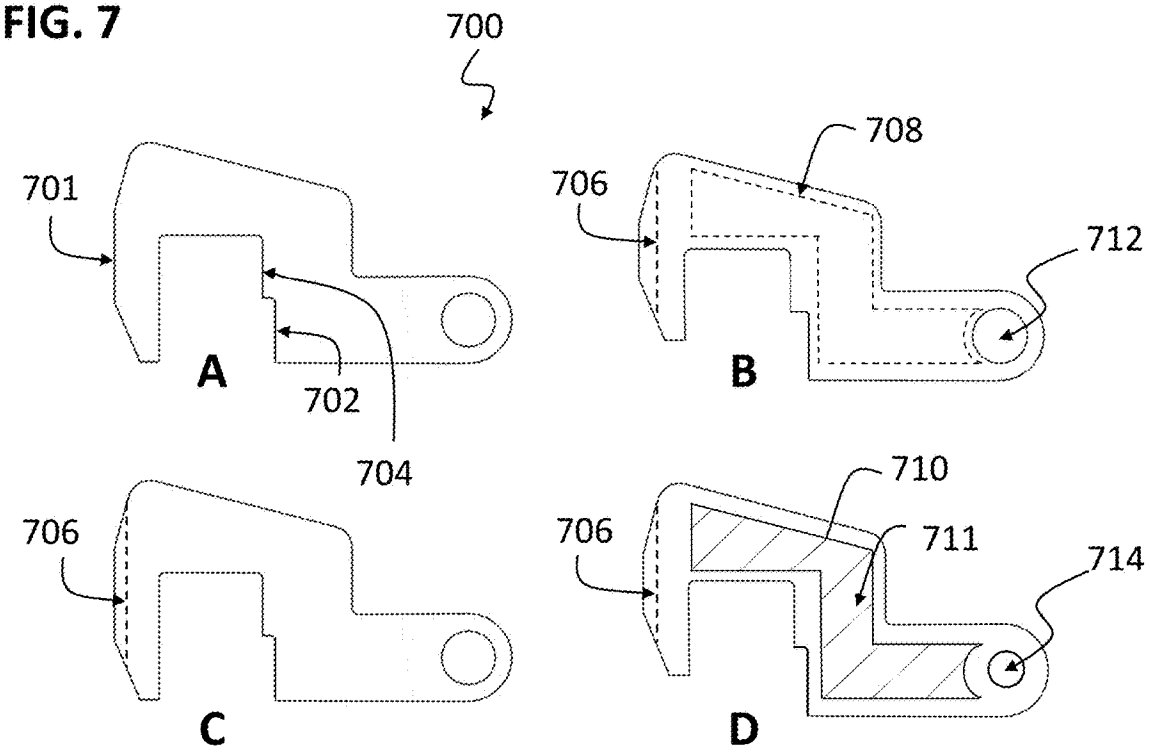

To illustrate how the optional guidance slot as described herein operates, FIG. 6 shows a sideview (View B) of a strut tool 600 positioned next to an end view (View A) of an AR-15 rifle barrel 616 showing the open rifle barrel bore 618 from end on with the forward, flat edge region of the hook portion or hook leading surface 606 inserted into the barrel bore 618. In this view the lower edge of the hook leading surface 606 immediately adjacent to the takedown block engagement region 608 comes into close fitting contact with the interior of the rifle barrel bore 618 forming a chord within the inner diameter thereof defined by said lower edge, so that the optional guidance slot region 602 is substantially centered with respect to the center axis of the rifle barrel bore 618, enabling the placement and guidance of a cleaning rod or inspection tool within the guidance slot 601 defining the lower edges of the guidance slot region 602 on which the cleaning or inspection tool would partially rest during use. The guidance slot region 602 corresponds to the guidance slot 601 open area and lower edge denoted in View B as dotted line 614, being the guidance slot cutout bottom trace, corresponding as above to the bottom most edge or extent of the guidance slot region 602 on which the cleaning or inspection tool would partially rest during use. Also shown in View A are the forward, beveled region or entry bevel region 602, and the rear wall of the takedown block engagement region 608, as well as the front surface 610 of the strut tool 600. Also shown in View B is the center axis of the strut tool 600 embodiment, in which the center axis is defined as the axis passing through the dead center of the struct block takedown pin bore 612 opening, extending parallel with respect to the leading edge or surface 610 of the strut body. It can be seen in the embodiment illustrated in FIG. 6 that the relative sizes and dimensions of the hook portion of the strut tool 600, including 604, 606 and the depth of 614 with respect to the top of the hook portion, can all be independently selected in order to dimensionalize the hook portion properly with respect to any selected inner rifle barrel bore diameter, so that upon entry of the forward, beveled region or entry bevel region 602 of the strut tool into the selected rifle bore, that the guidance slot region 602 and guidance slot 601 will be located co-incident to the barrel axis, i.e., approximately centered within the selected breech or rifle bore. FIG. 7 hereinbelow also shows the relative positioning of the guidance slot with respect to the bore of the barrel and is discussed in more detail below. It is to be noted that the guidance channel with its centered position helps to support the cleaning tool or inspection tool, as well as centering the tool within the bore and preventing or reducing contact therewith in order to prevent abrasion, contact, scratching or wear of any internal features, ridges or surfaces of the rifle bore.

FIG. 7 shows multiple embodiments 700 of strut tools, A, B, C & D having various additional optional features and configurations to enable them to be used with a variety of rifles for the purposes stated herein. In embodiment A, a solid strut toll features a smooth flat upper surface 701 without a guidance slot, but has two lower takedown block contact surfaces, 702 and 704, the former being a takedown block rest surface and the latter a clearance cutout that enables proper placement of the hook portion of tool A into an upper receiver opening of an AR10 rifle which has a larger takedown block. In embodiment B, the strut tool features a chambered or cored body defined by the open chambered region outline 708 shown in dotted line (on the back side, hidden from front view as shown), which can be formed by post machining of the tool, or formed by impression molding of this feature when the tool is first made. Embodiment B also has a guidance slot cutout shown by the trace 706 in dotted line, the depth and radius of which can be adjusted as desired, and a larger takedown pin bore 712 sized for the takedown pin. Embodiment C shows an otherwise solid strut tool having a guidance slot cutout denoted by trace 706, and an extended forward edge of the hook portion that extends further into the barrel or opening of a lower receiver (breech) as compared to Embodiment B. In embodiment D, the strut tool features a guidance slot cutout denoted by trace 706, and host a chambered region 711 defined by the chambered region wall 710, in addition to a smaller takedown pin bore 714.

In yet another embodiment, the instant invention includes a strut tool having two opposed hook portions with the openings of their respective takedown bock engagement regions facing in opposite directions, so that the dual hook strut tool can be used in one of two positions, with one of the selected hook portions inserted into a first rifle bore, breech or barrel for servicing a first rifle; and wherein in a second, independent servicing the second selected hook portion can be inserted into a second rifle bore, breech or barrel for servicing a second rifle. In related embodiments, the dimensions, sizes and orientations of the two hook portions and their corresponding takedown block engagement regions can differ so as to accommodate fitment to a first and second rifle bore, breech or barrel. In yet a further set of embodiments, the inventive strut tool can feature two strut block takedown pin bores located adjacent to one another and located within the pivot portion of the strut tool, enabling selection of the desired bore for use in placement and securing of the strut tool by means of insertion of the takedown pin within the selected strut block takedown pin bores, in order to increase or decrease the relative angular displacement of the upper and lower receiver assemblies with respect to one another when the strut tool is engaged accordingly. In yet another series of embodiments, the inventive strut tool can feature two or a plurality of strut block takedown pin bores having different internal diameters to accommodate different diameter takedown pin sizes.

Figure 8:
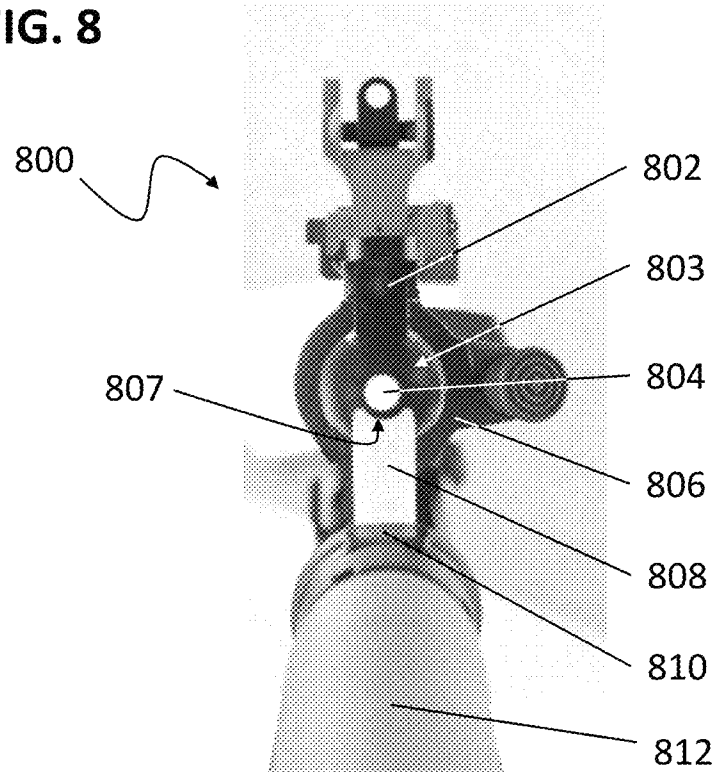
FIG. 8 shows a modified photographic view of one embodiment of a strut tool with a guidance slot aligned parallel and coincident with respect to the open center bore of the upper receiver assembly and with the longitudinal center axis of the barrel of an AR15 rifle.

FIG. 8 shows a photographic representation of the view down the rifle breech and barrel 806, the proximate rifle barrel bore 803 (which is dark and non-reflective), the distal rifle barrel bore opening 804 (light coming towards viewer from the far open end of the barrel opening) and upper receiver assembly of which the receiver engagement tang 802 of the breech is visible. The lower receiver assembly 812 and the buffer block 810 are visible in the fore ground, showing one embodiment of a strut tool 808 in position and the orientation of the guidance channel 807 with respect to the rifle barrel breech and bore opening.

As can be seen in FIG. 8, the position and orientation of the guidance channel 807 on the top of the strut tool 808 enables the positioning of a circularly shaped cleaning rod, tool or inspection tool, such as a fiber optic rod or camera, to be inserted into the rifle breech and barrel bore opening 804 and supported by the guidance channel 807 in a relatively centered position as the tool is pushed or maneuvered into and out of the rifle barrel bore.

Materials of Construction

The various inventive embodiments of the strut tool as disclosed and claimed herein may be manufacture from any suitable, resilient material, including, but not limited to, plastic, polymer, metal, alloys, resins and combinations thereof. Preferred materials are those having sufficient degree of structural strength and resistance to cleaning solvents and solutions typically employed when cleaning a firearm or rifle. Suitable polymers include, but are not limited to acrylonitrile, acetal resin (DuPont™ Delrin® acetal homopolymer resin), ABS (Acrylonitrile Butadiene Styrene), polyalkylenes (such as polybutylene, polyethylenediamine, polyethylene, etc.,), polystyrene, polymethacrylate, polyethylene terephthalate (PET), polyvinyl chloride (PVC), polyoxymethylene, DuPont™ Teflon® and cross-linked polymeric carbon and silicone based resins. Suitable metals include, but are not limited to, aluminum, copper, brass, iron, steel, titanium and alloys thereof, and combinations thereof.

Methods of construction include forming the strut tool as a machined part, with the various features, chambers, core regions, edges and bores being formed after casting of the base part, as well as direct casting or molding of the strut tool in substantially finished form or configuration, with or without post machining operations to render its final form and configuration as one or more embodiments of the inventive strut tool as disclosed herein. Also suitable is 3D printing of the strut tool, using computerized tomography to print out a solid shape in the final desired form using polymer printing, metal sintering and other similar manufacturing techniques that build a part layer by layer into an integrated final solid construct, with or without any additional post machining or processing operations.

The above illustration provides many different embodiments or embodiments for implementing different features of the invention. Specific embodiments of components and processes are described to help clarify the invention. These are, of course, merely embodiments and are not intended to limit the invention from that described in the claims.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

APPENDIX

Figure Keys

FIG. 1
100 Strut tool
102 Buffer block contact surface
104 Hook bevel region
106 Top crown region
108 Entry bevel region
109 Hook leading surface
110 Takedown block upper contact surface
111 Takedown block engagement region
112 Takedown block back surface
114 Takedown block lower contact surface
116 Strut body front surface
118 Strut block takedown pin bore
120 Rear surface
122 Strut thickness dimension FIG. 2
200 Hinged upper & lower assembly
201 Strut tool
202 Upper receiver unit
204 Port cover
206 Pivot block
208 Upper receiver port
210 Takedown block
212 Takedown block bore
214 Pivot pin
216 Strut block bore
218 Takedown pin
220 Threaded buffer coupling block
222 Lower receiver unit FIG. 3
300 Hinged upper & lower assembly
301 Strut tool
302 Upper receiver unit
304 Port Cover
306 Pivot block
308 Upper receiver port
310 Takedown block
312 Takedown block bore
314 Pivot pin

318 Takedown pin
320 Threaded buffer coupling block
322 Lower receiver unit
324 Cross-sectional cutaway view of 322
FIG. 4
400 AR-15 rifle
402 Upper receiver assembly
404 Handle
406 Pivot block (not shown)
408 Upper receiver port
409 Receiver engagement tang
410 Takedown block
412 Takedown block bore
414 Pivot pin
416 Takedown pin bore
418 Takedown pin
420 Buffer coupling block
422 Lower receiver assembly
424 Magazine receiver
426 Magazine release button
428 Trigger
430 Stock
432 Barrel guard cover
434 Front site assembly
436 Rifle barrel
438 Flash suppressor
440 Swivel direction indicator
442 Handle
FIG. 5
500 Chambered strut tool
502 Chambered recess region
504 Guidance slot
506 Hook depth
508 Hook displacement spacing
510 Takedown pin bore
520 Solid strut tool
522 Strut tool width
524 Buffer block contact surface
526 Takedown hook width
528 Takedown pin strut bore diameter
FIG. 6
600 Strut tool
601 Guidance slot
602 Guidance slot region
606 Hook leading surface
608 Takedown block engagement region
610 Strut body front surface
612 Strut block takedown pin bore
614 Guidance slot cutout bottom trace
616 Rifle barrel end on view
618 Rifle barrel bore
620 Center axis
FIG. 7
700 Strut tools
702 Takedown block rest surface
704 Takedown block clearance cutout
708 Chambered region outline
710 Chambered region wall
711 Chambered recess
712 Large takedown pin bore
714 Small takedown pin bore
720 Center axis
FIG. 8
800 Strut tool engaged with receivers
802 Receiver engagement tang
803 Rifle barrel bore (reflective internal surface)
804 Rifle barrel bore opening
806 Rifle barrel
807 Guidance channel
808 Strut tool—buffer block contact surface
810 Buffer block
812 Lower receiver assembly It is claimed:

1. A strut tool for servicing a firearm comprising:

(A) a hook portion for engaging an upper receiver assembly of said firearm; wherein said hook portion includes a takedown block engagement region;

(B) a pivoting portion for engaging the takedown pin of a lower receiver assembly of said firearm; wherein said pivoting portion includes a bore for receiving said takedown pin of said lower receiver assembly; wherein said hook portion and said pivoting portion act to reversibly hold said upper receiver and said lower receiver in a relative angular orientation with respect to one another by means of said hook portion engaging the takedown block of said upper receiver while simultaneously said pivoting portion engages said takedown pin of said lower receiver assembly;

wherein said hook portion comprises:

a. a hook leading surface substantially parallel to a center axis of said hook portion;

b. an entry bevel region extending to said hook leading surface and angled with respect to said hook leading surface to accommodate insertion of said hook leading surface into an interior breech or bore of said upper receiver assembly;

c. a top crown region extending from said entry bevel region;

d. a hook bevel region extending from said top crown region and angled with respect to said hook leading surface;

f. a buffer block contact region extending from said hook bevel region and extending to a buffer block contact surface of said pivoting portion;

e. a takedown block engagement region, immediately adjacent to said hook leading surface and including three internal contact surfaces:

i. a takedown block upper contact surface;

ii. a takedown block back contact surface; and iii. a takedown block lower contact surface;

wherein each of said three contact surfaces are oriented perpendicular with respect to each other; and wherein said takedown block back contact surface is oriented parallel to said center axis of said hook portion; wherein said takedown block lower contact surface extends to said hook leading surface of said pivoting portion; wherein said takedown block lower contact surface is oriented perpendicular to said entry bevel region of said pivoting portion.

2. The strut tool of claim 1 wherein said pivoting portion comprises:

a. a strut body front surface immediately adjacent to a takedown block engagement region; wherein said strut body front surface extends from said takedown block lower contact surface of said takedown block engagement region; wherein said strut body front surface is oriented substantially parallel to said center axis, and substantially perpendicular to said takedown block lower contact surface;

b. a rear surface extending from said strut body front surface to said buffer block contact surface;

c. a strut block takedown pin bore located within and extending cross-sectionally through said pivoting portion at a distal end of said pivoting portion between said rear surface and said strut body front surface; wherein the center of said strut block takedown pin bore defines one point along said center axis; and wherein said strut block takedown pin bore is internally sized to accommodate receiving a takedown pin of said lower receiver assembly.

3. The strut tool of claim 1, wherein a cross-dimensional first thickness of said hook portion and a second thickness of said pivoting portion are the same; wherein said first thickness is equal in size to a length of an internal chord segment of an internal bore of a barrel opening of said upper receiver assembly when said hook portion is inserted into said internal bore making contact with said bore at two points separated by a distance equivalent in length to that of said internal chord segment.

4. The strut tool of claim 3, wherein the cross-dimensional thickness of said pivoting portion corresponds to said second thickness and wherein said first thickness is either dimensionally smaller than said second thickness so that said hook portion can accommodate an upper receiver with a smaller bore size; or is dimensionally larger than said second thickness to accommodate an upper receiver with a larger bore size.

5. The strut tool of claim 1, wherein said top crown region includes a depressed guidance region; wherein said guidance region is configured in the form of a semicircular cross-sectional groove having a longitudinal aspect in a perpendicular orientation with respect to said center axis of said hook portion.

6. The strut tool of claim 1, wherein said top crown region includes a depressed guidance region; wherein said guidance region is configured in the form of a V-shaped cross-sectional groove having a longitudinal aspect in a perpendicular orientation with respect to said center axis of said hook portion.

7. The strut tool claim 1, wherein either one or both of said hook portion and said pivoting portion are cored to form one or a plurality of depressed regions extending inward from a first face of either said hook portion or said pivoting portion; and wherein said depressed regions do not extend completely to a second opposed face of said portion.

8. The strut tool of claim 7, wherein one or a plurality of said depressed regions extend inward from both of said opposed faces of either one or both of said hook portion and said pivoting portion to form opposed depressed regions on both of said opposed faces; wherein an intervening layer of a material of construction remains between said opposed depressed regions.

9. The strut tool of claim 7, wherein one or a plurality of said depressed regions are cored from both of said opposed faces creating an opening without an intervening layer of a material of construction.

10. The strut tool of claim 1 having a first hook portion and second opposed hook portion; wherein said first and second hook portions extend to said pivoting portion; and wherein a first opening of said first hook portion and said second opening of said second hook portion are oriented in opposite directions; and wherein said first and said second opening correspond to a first and a second takedown block engagement region.

11. The strut tool of claim 10 wherein at least one dimension of said first and second hook portions are different in size in order to accommodate servicing of two separate rifles.

12. The strut tool of claim 10 wherein said pivoting portion includes a first bore and a second bore for receiving the takedown pin of said lower receiver assembly.

13. The strut tool of claim 12 wherein said first bore has a first internal diameter that corresponds to the outer diameter of a first takedown pin of a first rifle and said second bore has a second internal diameter that corresponds to the outer diameter of a second takedown pin of a second rifle.

* * * * *